US005568803A

United States Patent [19]

Brown

[11] Patent Number: 5,568,803

[45] Date of Patent: Oct. 29, 1996

[54] RELATING TO GASEOUS FUEL BURNER ASSEMBLIES AND TO APPLIANCES INCORPORATING SUCH BURNER ASSEMBLIES

[76] Inventor: Geoffrey J. E. Brown, 9 Trentham Close, Widnes, Cheshire WA8 9RH, United Kingdom

[21] Appl. No.: 416,159

[22] Filed: Apr. 4, 1995

[51] Int. Cl.[6] ..... F24C 15/32

[52] U.S. Cl. ..... 126/21 A; 126/273 R; 432/176; 432/199

[58] Field of Search ..... 126/273 R, 21 R, 126/21 A, 39 R; 432/199, 176; 431/168, 169, 354, 115, 116; 34/225

[56] References Cited

U.S. PATENT DOCUMENTS

| | | | |
|---|---|---|---|
| 4,087,234 | 5/1978 | Delyannis | 431/168 |
| 4,823,766 | 4/1989 | Violi . | |
| 5,121,737 | 6/1992 | Yencha III . | |

FOREIGN PATENT DOCUMENTS

| | | | |
|---|---|---|---|
| 0244927 | 11/1987 | European Pat. Off. . | |
| 0388751 | 9/1990 | European Pat. Off. . | |
| 0409324 | 1/1991 | European Pat. Off. . | |
| 0499325 | 8/1992 | European Pat. Off. . | |
| 0609157 | 8/1994 | European Pat. Off. . | |
| 1174722 | 12/1969 | United Kingdom | 431/168 |
| 2090967 | 7/1982 | United Kingdom . | |
| 2149904 | 6/1985 | United Kingdom . | |

OTHER PUBLICATIONS

English translation of EP–A–0609157.

*Primary Examiner*—James C. Yeung
*Attorney, Agent, or Firm*— N. Rhys Merrett

[57] ABSTRACT

A gaseous fuel burner assembly for heating a space particularly an oven of a domestic cooking appliance comprises a gaseous fuel burner separated from the space by a baffle plate, and, also separated from the space by the baffle plate, a fan for withdrawing air from the space via an aperture or apertures in the plate and returning that air to the space via an exit or exits adjacent the edge of the plate, the or each aperture being so located that, during its passage from the aperture or apertures to the exit or exits, the air passes close to the burner. The fan may also draw in air from a plenum chamber behind the oven. The burner may be of the duplex variety and may have two independently controllable burner heads.

27 Claims, 6 Drawing Sheets

RELATING TO GASEOUS FUEL BURNER ASSEMBLIES AND TO APPLIANCES INCORPORATING SUCH BURNER ASSEMBLIES

BACKGROUND OF THE INVENTION

This invention relates to gaseous fuel burner assemblies and to appliances incorporating such assemblies. The invention has particular reference to gaseous fuel burner assemblies for gas-fired cooking appliances for example, domestic gas-fired cooking appliances.

Many conventional domestic, gas-fired, cooking appliances include cooking ovens that are heated by a gaseous fuel burner located at the back of the oven usually just below an opening in the floor of the oven. It is found that, in such cases, the temperature inside the oven when the latter is in use varies from the front to the back of the oven and also from the top to the bottom thereof. That variation results in uneven heating and thus uneven cooking of foodstuffs in the oven.

SUMMARY OF THE INVENTION

Accordingly, it is an object of the present invention to provide a gaseous fuel burner assembly which, when installed in a gas-fired appliance, gives a more even heating.

According to the present invention a gaseous fuel burner assembly for heating a space comprises a gaseous fuel burner separated from the space by a baffle plate, and, also separated from the space by the baffle plate, a fan for withdrawing air from the space to be heated via an aperture or apertures in the plate and returning that air to the space via an exit or exits adjacent the edge of the plate, the or each aperture being so located that, during its passage from the aperture or apertures to the exit or exits, the air passes close to the burner.

The burner may comprise a burner head carried by a conduit for supplying gaseous fuel to the burner head.

The assembly may also comprise a motor for driving the fan and in this case, the conduit is the rotor shaft of the motor.

The fan may comprise a fan blade that is secured to the rotor shaft for rotation therewith.

Alternatively, the fan may have a fan blade that is secured to the burner head for rotation therewith.

In another embodiment of the invention the motor has a rotor shaft to which the burner head is secured for rotation therewith, and the fan has a fan blade fixed to the burner head for rotation therewith, the rotor shaft passing through the conduit.

The assembly may include a tube for supplying gas to the conduit and the tube may terminate in an injector positioned to direct gas into the conduit.

The burner head may be a hollow cylindrical body whose interior is in communication with the conduit, one face of the body being a porous disc the forms the combustion surface of the burner. The disc faces the baffle which is so located that it lies centrally with respect to the disc.

in another embodiment of the invention the fan is mounted for rotation about an axis that is coaxial with the conduit, the fan being rotated by a motor via drive transmitting means interconnecting an output shaft of the motor with the fan.

The burner may be a duplex burner and may comprise two burner heads each with its own fuel supply conduit.

The burner heads may be arranged coaxially as may the conduits. The conduits may be arranged one within the other and, in this case, the inner conduit is secured to the rotor of the motor for rotation therewith and the outer conduit is secured to the inner conduit for rotation therewith.

According to another aspect of the present invention a gas-fired cooking appliance has an oven heated by a gaseous fuel burner assembly of a form described in one or other of the preceding paragraphs.

By way of example only embodiments of the invention will now be described with reference to the accompanying drawings.

DETAILED DESCRIPTION OF THE PREFERRED EMBODIMENTS

Figure 1:
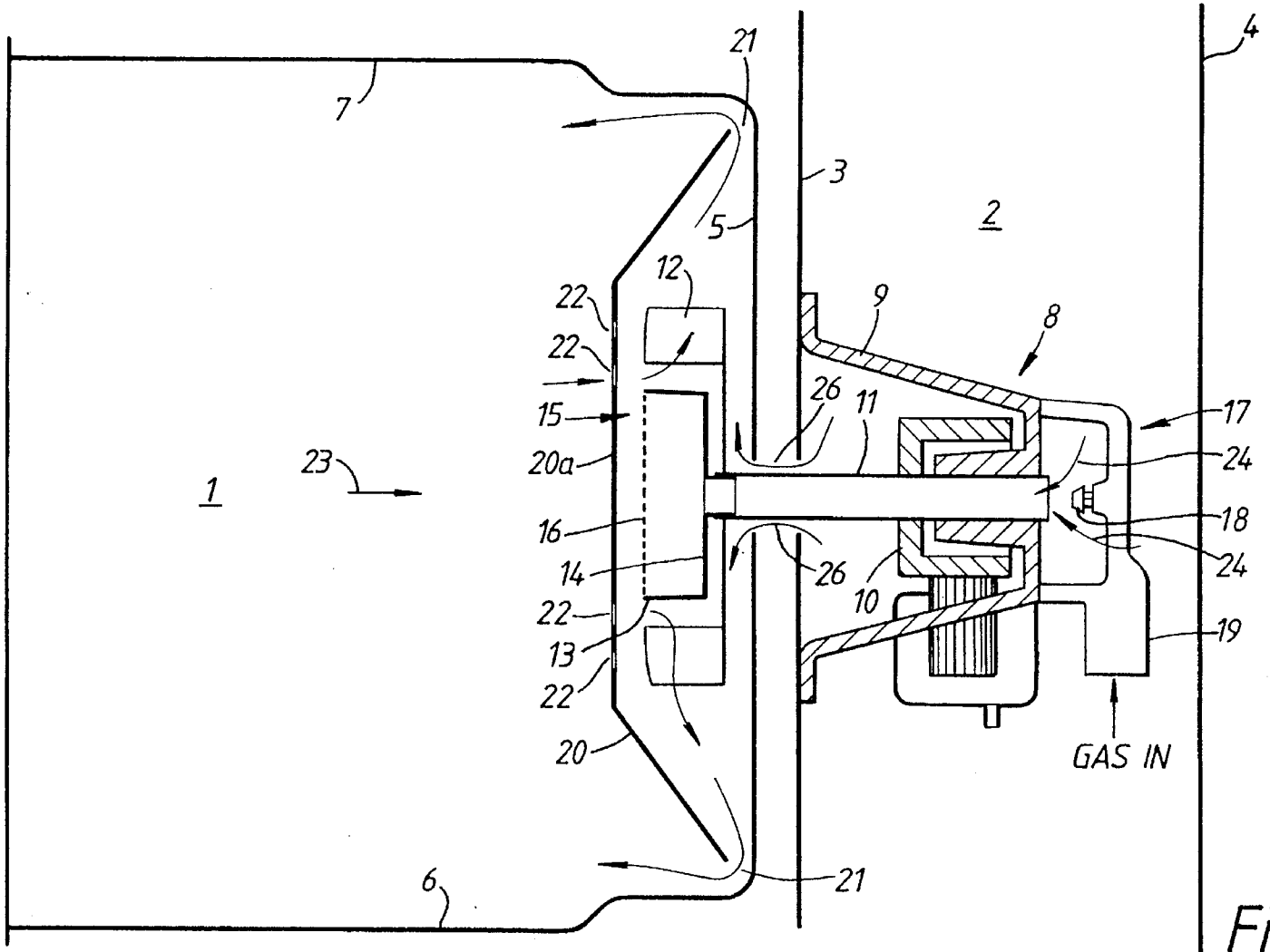
FIG. 1 is a simplified, diagrammatic side view of a first embodiment of a gaseous fuel burner assembly.

FIG. 1 show, in simplified diagrammatic form, a burner assembly embodying the invention and suitable for heating a space 1 which, in this embodiment is the oven cavity of a domestic gas cooker. The gas cooker is of a construction described in UK Patent Application No. GB 2255632A (9208761.8) and has, behind the cavity 1 a plenum chamber 2 bounded by a front wall 3 and a rear wall 4 and into which air from atmosphere is drawn by a fan not shown in FIG. 1. The cavity 1 has a rear wall 5, a floor 6, a roof 7 and side walls. The rear wall 5 is spaced from the front wall 3 of the plenum chamber 2 and the space may be filled with a thermal insulating material.

Housed within the plenum chamber 2 is an electric motor 8 supported on a framework 9 mounted on the front wall 3 of chamber 2. The rotor 10 of motor 8 is mounted for rotation with a hollow shaft 11 which extends with clearance through both front wall 3 and rear wall 5 and extends into the cavity 1 as shown. The shaft 11 is rotatably supported in suitable bearings carried by the framework 9 but not shown in FIG. 1.

On that end of shaft 11 that lies inside the cavity 1 is secured a centrifugal fan blade 12 whilst a burner head 13 is fixed to that same end. The burner head 13 is a hollow cylindrical body whose interior is in communication with the inside of the shaft 11 via an opening in the end wall 14 of the head 13. The front wall 15 of the burner head 11 consists of a porous disc 16 that is the combustion surface of the burner. The disc may be made of a mesh or a fibrous mass of stainless steel, or it may be a perforated disc of stainless or a porous ceramic disc.

The other end of shaft 11 projects into a double-walled structure 17 and is in communication with the atmosphere bounded thereby. Mounted on the inner wall of structure 17 is an injector 18 that is aligned with the center of the open face of the shaft 11 and spaced therefrom by a short distance as shown. The space between the walls of structure 17 is joined to a gas supply pipe 19.

Covering the fan 12 and the burner head 13 and separating them from the interior of the cavity 1 is a dished baffle 20 of plate-like form and whose periphery lies close to the end wall 5 of the cavity 1 and is separated therefrom by an annular gap 21. The floor 20*a* of the baffle 20 has apertures 22 arranged in a series of concentric circles when viewed in the direction of arrow 23. It will be noted that there are no apertures over that area of the floor 20*a* that lies immediately in front of the disc 16. In that way, there is little or no direct impingement of air on the surface of the disc 16 and minimum disruption of the flame pattern on that surface.

The supply of gas to the interior of the structure 17 via pipe 19 is controlled by a gas flow control means not shown in FIG. 1 and the means will incorporate some form of thermostatic control having a temperature sensor exposed to the temperature of the cavity 1. In addition, the burner 13 will, preferably, have an ignition device which is brought into operation when the gas control is operated to its "ON" position.

Also linked to the control means is an electric switch controlling the energisation of the motor 8 and also another switch controlling energisation of the motor driving the fan in the plenum chamber 2.

When it is desired to carry out a cooking operation in the oven, the foodstuff to be cooked is place on an oven shelf (not shown) and the gas control is turned to its "ON" position. That action results in energisation of the motor 8 and also operation of the ignition device. At the same time, the motor driving the fan in the plenum chamber 2 is also energised if not already running. Gas issuing from injector 18 entrains primary air which flows into the open end of the shaft 11 assisted by the air pressure existing in the plenum chamber. Flow of air into the shaft is also assisted by the rotation of fan 12 blade. In FIG. 1 the flow of air is indicated by the arrows 24. The air mixes with the gas as it flows along the interior of the shaft 11. The resultant mixture is ignited on the surface of the disc 16 which quickly reaches an incandescent state and heat is transmitted to the baffle and thence to the interior of the cavity 1. Energisation of motor 8 rotates the fan blade 12 and air from the interior of the cavity 1 is drawn through the apertures 22 and over the hot surface of the baffle and being discharged back into the cavity 1 via the gap 21. There is thus a circulation of hot air within the cavity 1 and the latter is quickly heated to a desired temperature. The circulation of air ensures that the cavity 1 rapidly attains an even temperature throughout. There is also a small flow of air into the space bounded by the baffle and the rear wall 5 via the clearances between the shaft 11 and the walls 3 and 5. That flow, indicated by arrows 26, ensures that air inside the cavity does not become vitiated to an extent that it cannot support the combustion of gas on the disc 16 and also provides air to make up for losses due to the usual small outflow of air from the cavity 1.

Once the temperature of the cavity has reached that to which the thermostat has been set, the supply of gas is turned "ON" and "OFF" as necessary to maintain the cavity temperature at the set value.

At the end of the cooking operation, the gas flow control means is returned to its "OFF" position that movement de-energising motor 8 and terminating the circulation of air within the cavity 1. The motor driving the plenum chamber fan may also be de-energised.

It will be understood that the space 1 need not be that of an oven cavity but the space of some other gas-fired appliance, for example, the space could contain a heat exchanger which may be part of air conditioning plant or a space heater.

It may be desirable to replace the center part of the floor 20*a* of the baffle 20 i.e. that part directly ahead of the disc 16 with a circular plate of heat-resistant glass or some other heat-resistant transparent material. The burner surface will then be visible to a user who is thus able to check that the burner is working.

Figure 2:
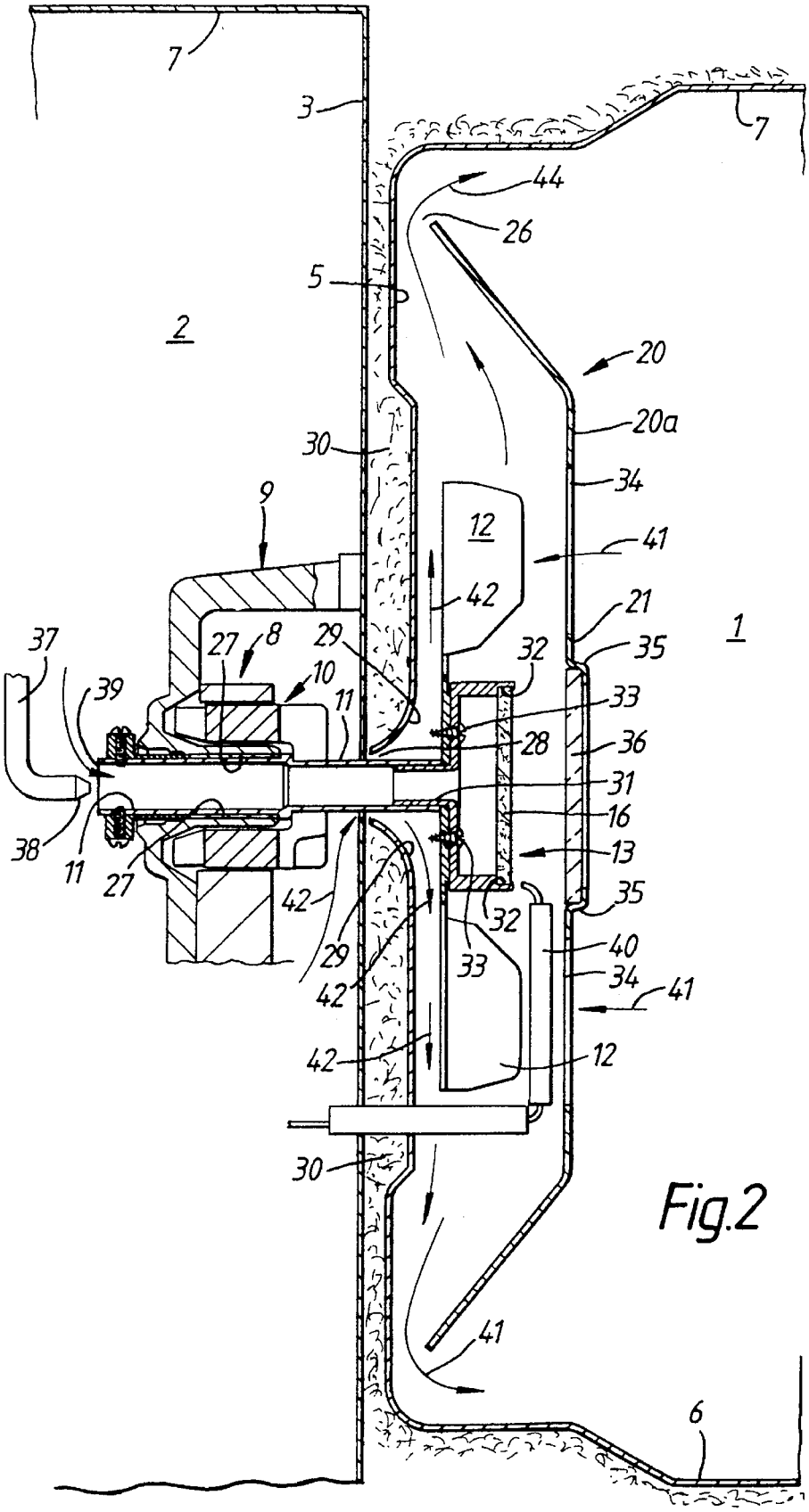
FIG. 2 is a side view in simplified form of part of a gas-fired cooker incorporating a burner assembly embodying the invention.

FIG. 2 shows, in greater detail, a slightly modified version of the embodiment of FIG. 1.

In FIG. 2, parts similar to those of FIG. 1 have been given the same reference numbers.

Located in the plenum chamber 2 is the motor 8 that is supported on a framework 9 mounted on the front wall 3 of chamber 2. The rotor 10 of motor 8 is mounted for rotation with a hollow steel shaft 11 on which the rotor is a force fit. The shaft is mounted for rotation in the supporting framework 9 by sintered bronze bearings 27. The shaft 11 extends with clearance through an aperture 28 in the rear wall 5 of the cavity 1. As can be seen in FIG. 2, the surface of the rear wall 3 of the plenum chamber 2 is smoothly rounded towards aperture 28 as shown at 29 thereby maintaining a smooth flow of air through the aperture as will be explained below. Also shown in FIG. 2 is thermal insulation 30 that is located between the walls of the cavity and the rear wall 3 of the plenum chamber.

In the embodiment shown in FIG. 2, the cylindrical body of the burner head 13 has a central tubular extension 31 that is a drive fit in the adjacent end of the shaft 11. The edge of the cylindrical body of the burner is stepped as at 32 to receive the disc 16 that forms the combustion surface of the burner.

Fan blade 12 is secured to the rear surface of the burner head by means of self-tapping screws 33 as can be seen in FIG. 2.

The embodiment of FIG. 2 also has a baffle 20 of a shape similar to the baffle 20 of FIG. 1 except that the air inlet apertures 22 of the FIG. 1 baffle are, in FIG. 2, replaced by spaced openings 34 whose inner edges are clear of the disc 16 thus preventing the direct impingement of air on the disc and deleteriously affecting the combustion of the gaseous fuel. In addition, there is a further and circular aperture in baffle 20 located centrally of the floor 20*a* of the baffle and aligned with the disc 16. The inner edges of the circular aperture are upset as indicated at 35 to receive a window 36 of heat-resistant glass or other suitable transparent material.

Gas is supplied to the burner by a pipe 37 from a gas supply main (not shown). Pipe 37 terminates in an injector 38 that is aligned with the center of the open end 39 of the shaft 11 and thus fires directly along the longitudinal axis thereof.

FIG. 2 also shows an igniter electrode 40 of the igniter that is brought into operation when the gas flow control means in the gas supply line to the burner is operated to an "ON" condition. Linked to that control means is the switch controlling energisation and de-energisation of motor 8 and also that of the motor driving the fan in the plenum chamber.

The embodiment of FIG. 2 operates in a manner generally similar to the of FIG. 1. When the gas flow control is operated to an "ON" condition, gas emerges from the injector 38 and entrains air from the plenum chamber 2. The air in the plenum chamber is under pressure and this assists the action of the injector to ensure that an adequate volume of air flows into the shaft 11 to mix with the gas emerging from the injector 38 during passage along the shaft 11 to the head of the burner. The mixture is ignited on the outer surface of the disc 16. Air within the cavity 2 is drawn in through the openings 34 and is driven under the action of the fan blade 12 to the gap 21 and thence back into the cavity 1. That air flow is indicated in FIG. 2 by the arrows 41. As indicated by arrows 42, air also drawn by the fan blade 12 through the opening 28 over the smoothly contoured surface 29 and serves as in the embodiment of FIG. 1 to prevent vitiation of the air circulating within the cavity and also to make up air losses that occur by reason of the controlled escape of combustion products from the oven via vents in the oven door or other exits from the oven cavity.

Thus, as is described above in relation to FIG. 1 there is a flow of heated air into the cavity and this, combined with heat conducted through the baffle 20 ensures that the temperature of the interior of the cavity 1 rapidly reaches a preset value and that there is a constant temperature throughout the cavity.

Operation of the control means to its "OFF" condition de-energises motor 8 and may also de-energise the motor driving the fan in the plenum chamber.

Figure 3:
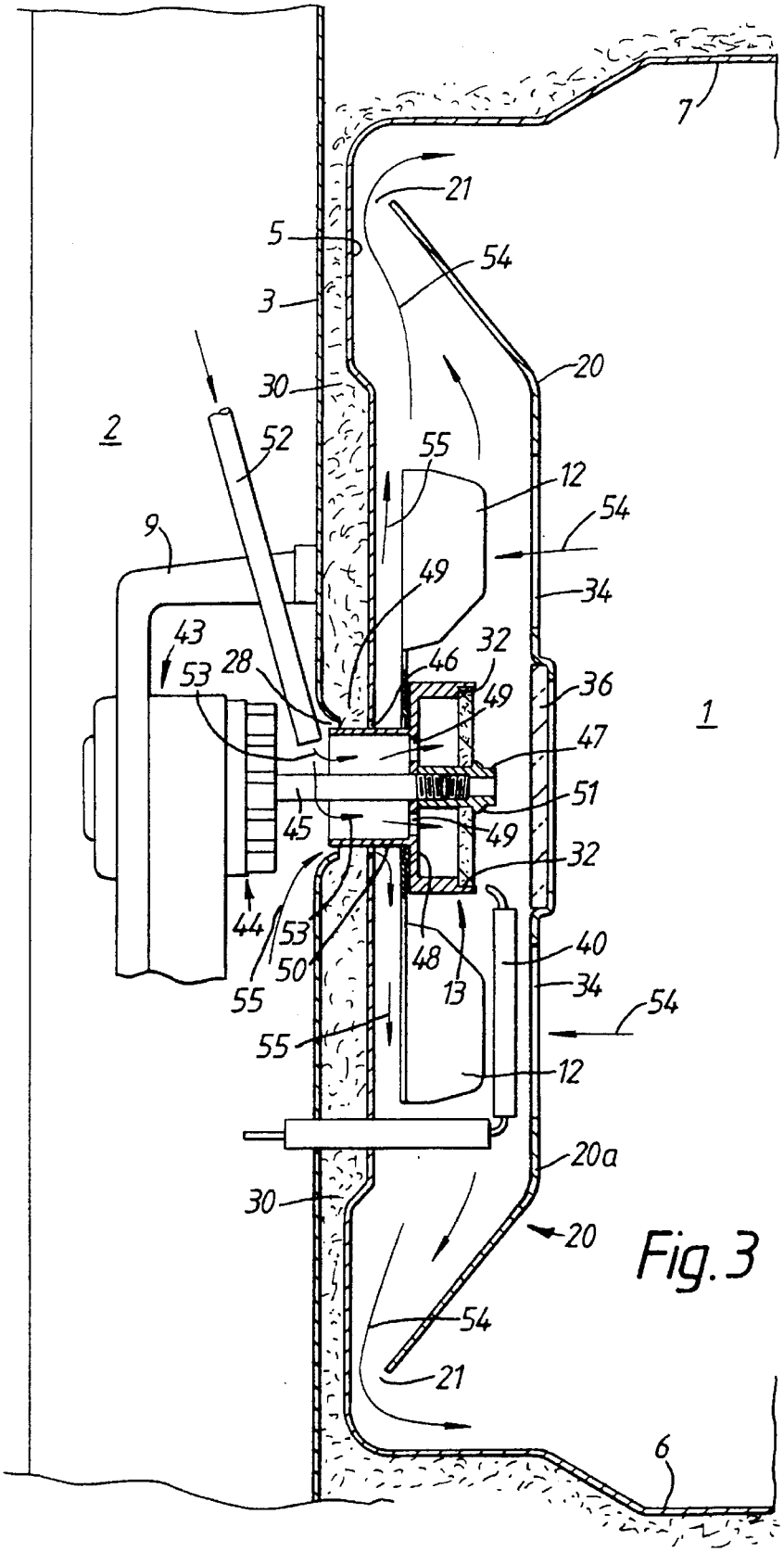
FIG. 3 is a side view in simplified form of part of a gas-fired cooker incorporation a gas burner assembly embodying the invention.

The embodiments of FIGS. 1 and 2 both require the use of hollow motor shafts to carry the fuel mixture to the burner head but this is not essential and FIG. 3 shows an further embodiment which does not require a motor with a hollow rotor shaft.

The construction of the embodiment of FIG. 3 is generally similar to that of the embodiment of FIG. 2 and components that are the same in both embodiments have been given the same reference numerals as in FIG. 2.

Thus, plenum chamber 2 houses a motor 43 of conventional construction and whose rotor 44 is mounted on a rotor shaft 45 that extends through aperture 28 in the front wall 3 of the chamber 2 and also through aligned hole 46 in the rear wall 5 of the oven cavity 1. The shaft 45 terminates in the oven cavity adjacent wall 5 and the end thereof is screw-threaded to receive a tubular nut 47 by which burner head 13 is fixed to the shaft 45. Shaft 45 passes through the rear wall 48 of the burner head as shown. Wall 48 has a series of apertures 49 in it, the apertures lying on a circle that is concentric with the longitudinal axis of the shaft 45.

Burner head 13 also has a rearwardly extending tubular portion 50 of a relatively large internal diameter. Portion 50 is coaxial with shaft 45 and projects through the hole 46 and aperture 28 with some clearance to permit a limited flow of air from the chamber 2 as will be explained below. As in the embodiment of FIG. 2, burner 13 is a surface combustor, fuel burning on the surface of the disc 16 that is held against a shoulder 32 of the head by an external flange 51 on the nut 47.

Fan blade 12 is mounted on the burner head 13 and is secured to the rear wall 48 thereof.

Passing through the chamber 2 is a tube 52 that conveys an air/gas mixture from a mixing chamber located on the external surface of a wall of the plenum chamber 2. The mixing chamber is supplied with gas and air from a source of air under pressure, the two supplies mixing in the chamber before passage along tube 52. The use of such mixing chambers is described in UK Patent Application No. 93.17632.9 (Publication GB-A-2270750). Tube 52 terminates adjacent the open end of portion 50 and gaseous fuel mixture emerging therefrom enters the portion as indicated by arrows 53 and passes to the burner head 13 by way of apertures 49.

Located between the burner head 13 and the cavity 1 is the baffle 20 that is identical in form with baffle 20 of the embodiment of FIG. 2.

The FIG. 3 embodiment operates in a manner similar to the of FIG. 2. Operation to its "ON" position of the gas flow means controlling the flow of gas to the mixing chamber results in the flow of fuel mixture to the burner head where it is ignited on the surface of disc 16 by igniter 40. At the same time, motor 43 is energised as is the motor driving the fan in the plenum chamber 2. Rotation of fan 12 blade by motor 43 draws in air from the cavity 1 through the openings 34 and pumps it out through the gap 21, the flow being indicated by arrows 54. Air is also drawn in through gap 28 as shown by arrows 55 as serves as before to prevent vitiation of the air within the cavity 1 and to make up for the escape of combustion products as is described above.

As in the embodiments described above in relation to FIGS. 1 and 2, the interior of the cavity rapidly reaches a desired temperature that is constant throughout the cavity.

Operation of the control means to its "OFF" condition de-energises the electric motor 43 and may also de-energise the motor driving the fan in the plenum chamber.

Figure 4:
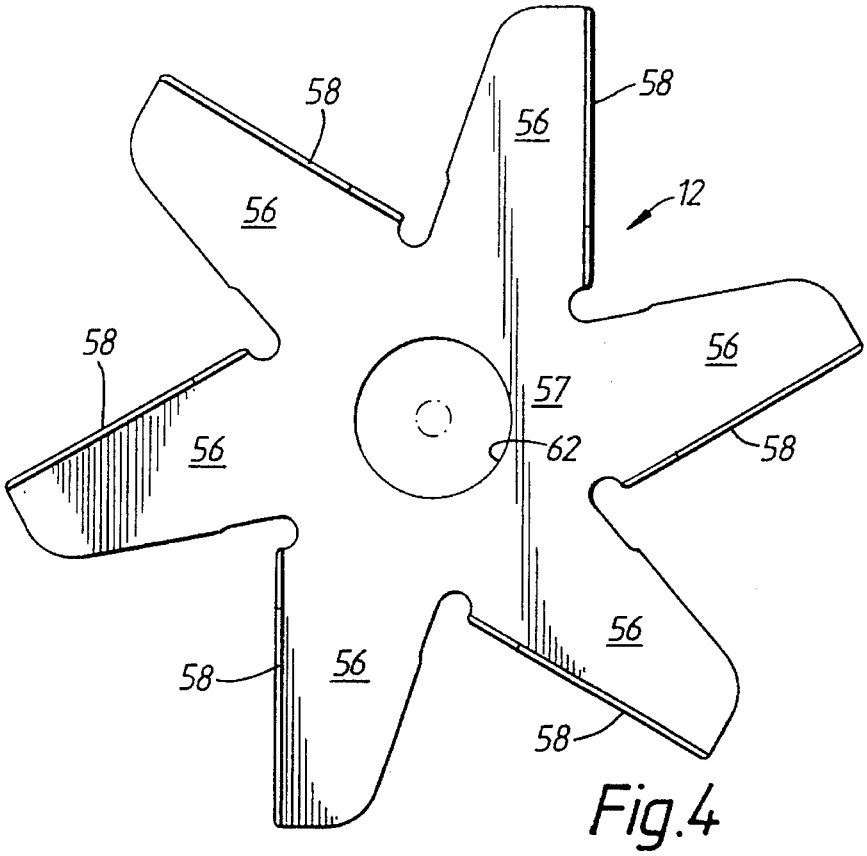
FIGS. 4 and 5 are, respectively, front elevation and side view of a component of a burner assembly, and, FIGS. 6 and 7 are a diagrammatic representations of further embodiments of the invention.
Figure 5:
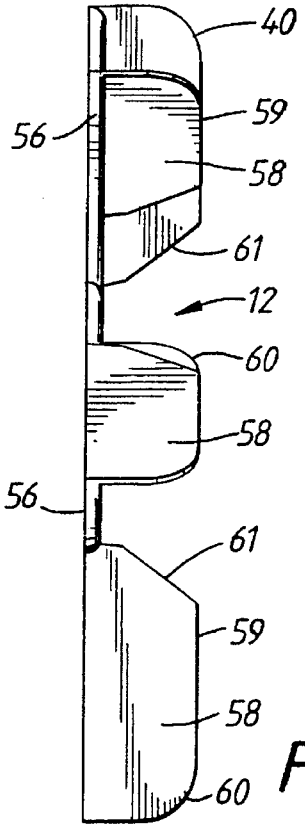

FIGS. 4 and 5 are, respectively, a front elevation and side view of a fan blade 12. The blade is made from a sheet of mild steel, for example, and has six arms 56 that extend radially from a central area 57. Each arm 56 has an upturned edge 58 that projects at right angled from the remainder of the arm and has a top end 59 that is rounded at one end as shown at 60 and has an inclined edge 61 at the other end. The central area 57 has a central hole 62 whose diameter depends on whether the blade is to used in the embodiment of FIG. 1 or FIG. 2 or FIG. 3. Additionally, if the blade is to be used in the embodiment of FIG. 2, the central area will have holes to receive the screws 33 by which the blade is fixed to the burner head.

It will be understood that it is not essential to embody the burner assembly in a cooker with a plenum chamber situated at the rear of the oven cavity. It is possible to rely on the fan blade 12 to draw in sufficient air to provide an adequate supply of both primary and secondary air to support full combustion of the gas in the gaseous fuel.

Furthermore, it is not essential to use a fan blade that is rotated by a motor whose rotor shaft passes through the conduit that supplies gaseous fuel to the burner head. In another embodiment, the burner head is fixed relatively to the cooker structure and the fan, although rotatable about an axis that is coaxial with that of the burner head, is driven by a motor positioned adjacent to the burner head but not aligned therewith.

Figure 6:
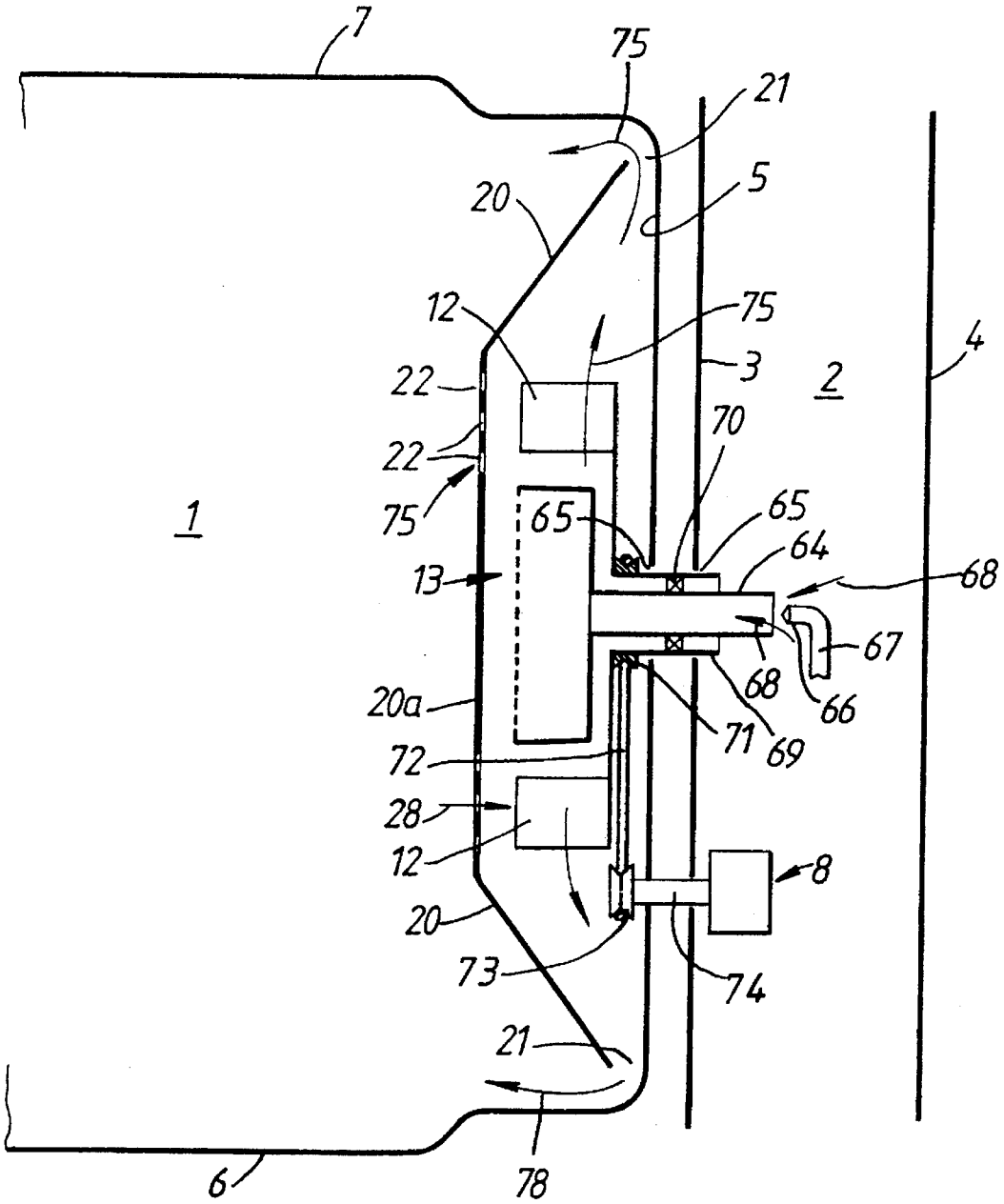

Such a driving arrangement is illustrated in diagrammatic form only in FIG. 6 which shows the arrangement in an oven context similar to FIG. 1. In FIG. 6 components that are similar to those of FIG. 1 have been given the same reference numerals.

The burner head 13 is fixed to the end of a gaseous fuel supply conduit 64 that extends through apertures 65 in the front wall 3 of the plenum chamber 2 and in the rear wall 5 of an oven cavity 1. Gas is supplied to the open end of conduit 64 via an injector 66 at the end of a gas supply pipe 67 and gas exiting therefrom entrains primary air as indicated by arrows 68. The pressure in chamber 2 assists that entrainment.

Fan blade 12 is carried by a hollow shaft 69 rotatably mounted in bearings 70 disposed around the conduit 64. A pulley 71 fixed to the shaft 69 is coupled by a driving belt 72 to a pulley 73 fixed to the rotor shaft 74 of a driving motor 8. Motor 8 is housed in the plenum chamber 2.

Fan 12 and burner head 13 are separated from the oven cavity 1 by the baffle 20 whose periphery is spaced from the adjacent rear wall 5 by a gap 21.

The embodiment of FIG. 6 operates in the same manner as does the embodiment of FIG. 1. When the gas flow means controlling the supply of gas to injector 66 is operated to an "ON" condition, gas enters the conduit 64 and in so doing entrains air as indicated by arrows 68 and the mixture passes down conduit 64 to the burner head 13 where it is ignited on the surface thereof by an igniter (not shown) that is energised when the gas flow control means is operated. Operation of the gas flow control means also energises motor 8 and fan blade 12 is rotated and air from cavity is drawn in through apertures 22 and is pumped out through the gap 21 as indicated by the arrows 75. Operation of the gas flow control means also energises the motor driving the fan in the plenum chamber if that fan is not already operating.

The cavity 1 rapidly reaches the desired preset temperature at this is constant throughout the cavity.

Operation of the control means to its "OFF" condition, de-energises motor 8 and may also de-energise the motor driving the fan in the plenum chamber 2.

The embodiment of FIG. 6 can also be used without the plenum chamber 2 in which case primary air is drawn from the atmosphere primarily by the action of fan blade 12 assisted by the entrainment effect of gas issuing from the injector.

In the embodiments described above with reference to FIGS. 2, 3 and 6, the flow of gaseous fuel to the burner head is either fully "ON" or "OFF". It is possible to use a burner head of a duplex construction providing a low heat output or a higher heat output. In that case, the preset temperature is maintained by using either the low or the higher heat output of the duplex burner.

Figure 7:
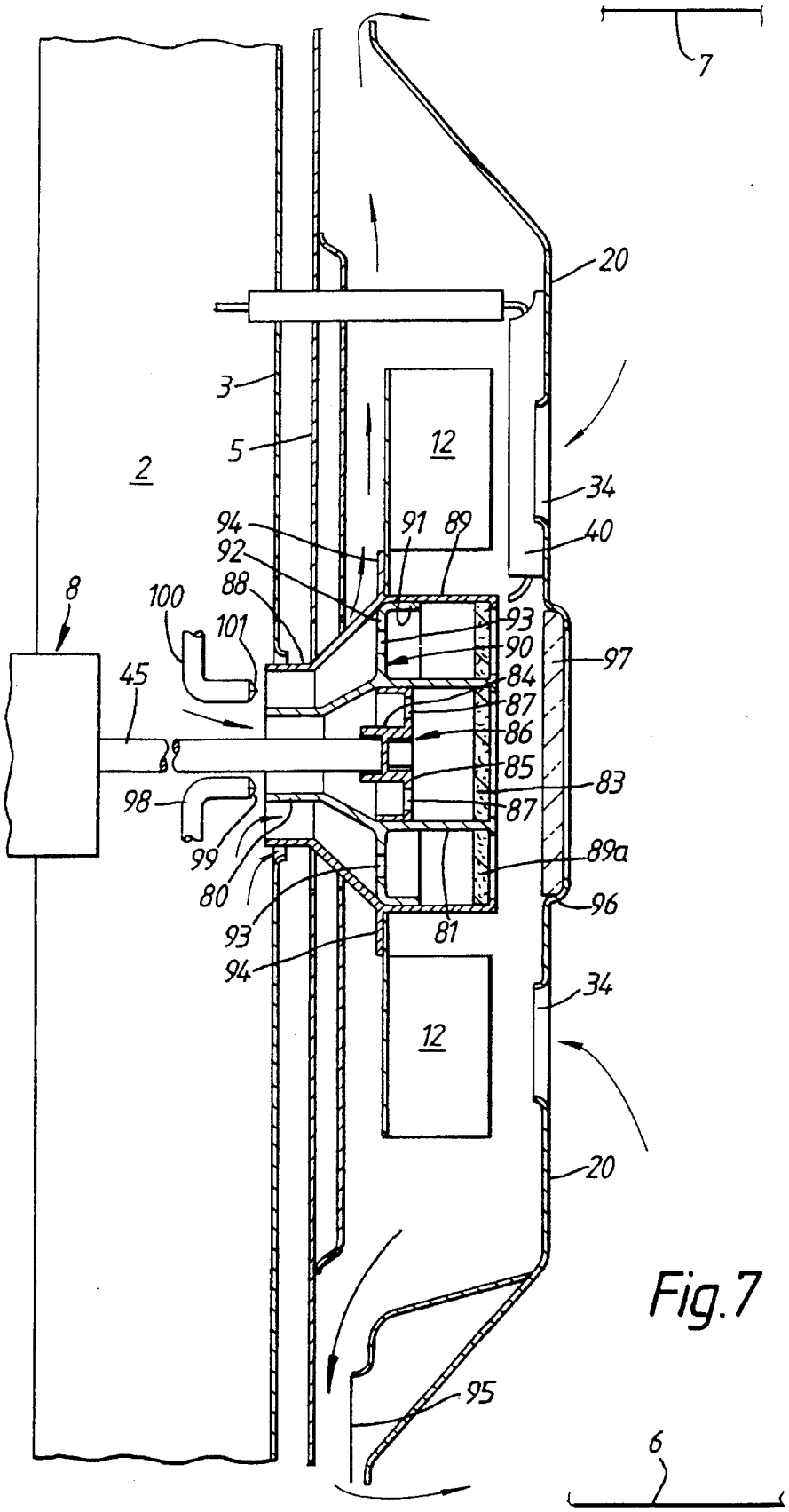

FIG. 7 is a simplified drawing of an oven with a gas burner assembly having a duplex gas burner.

In FIG. 7 components similar to those already described above with reference to FIG. 3 have been given the same reference numerals as in that FIG.

Motor 8 has a rotor shaft 45 that extends through an inner conduit 80 having a bell shaped end 81 that carries an inner, surface combustor disc 83. The shaft 45 is secured to the tubular extension 84 of the end wall 85 of a member 86 that locates internally of the end 81 as seen in FIG. 7. The end wall 85 has a series of spaced circular holes 87 whose centers lies on a circle that is concentric with the longitudinal axis of shaft 45.

Conduit 80 lies within an outer conduit 88 of a shape that corresponds with that of the inner conduit and has a bell-shaped end 89 that carries an outer surface combustor annulus 89a and that is supported from end 81 by a cup-shaped member 90. Member 90 has a peripheral flange 91 which is secured to the end 88 as seen in FIG. 7. The floor 92 of member 90 also has a series of circular holes 93 whose centers lie on a circle that is also concentric with the longitudinal axis of shaft 45.

Bell-shaped end 89 also has an external flange 94 to which is fixed the fan 12 that circulates air from the cavity 1 through the space behind baffle 20 via a series of spaced, circular inlet apertures 34 to a series of outlet holes 95 adjacent the periphery of the fan. Baffle 20 also has a central aperture 96 that is aligned with the ends of members 81 and 89 and the surface combustors carried thereby. In aperture 96 is mounted a transparent, heat-resistant window 97.

Gaseous fuel at a relatively low rate is supplied to the inner conduit 82 by a gas supply pipe 98 with an injector 99 at its end. A second gaseous fuel pipe 100 supplies fuel at a relatively high rate to the passage between the inner and outer conduits 82 and 88. Pipe 100 also has an injector 101 at its end as shown.

The flow of gaseous fuel along pipes 98 and 100 is controlled by fuel flow control means which allows a user to select which of the surface combustors 82 and 83 is to be bought into use or the means may be such that the inner combustor 83 is always brought into use first and is followed automatically by the outer combustor 89*a* either when a predetermined temperature in the cavity 1 has been attained or after a predetermined time delay. Subsequently, when the temperature in the cavity 1 reaches a value preset by the user, that temperature is maintained by the "ON"-"OFF" operation of the inner combustor 83. Alternatively, it is possible to maintain the preset temperature by the "ON"-"OFF" operation of the outer combustor 82.

Subject to the operation of the combustors 83 and 89*a* as just described, the operation of the embodiment of FIG. 7 is the same as that of the embodiment of FIG. 6.

I claim:

1. A gaseous fuel burner assembly for heating a space defined in part by walls extending transversely from an end wall; comprising a baffle supported within said space to permit airflow at its periphery between said baffle and said transversely extending wails; said baffle having at least one aperture therein; a gaseous fuel burner including a burner head supported between said end wall and said baffle to confront a central area of the baffle, a motor having a rotor shaft drivably coupled with said burner head; said rotor shaft providing a gaseous fuel supply conduit communicating with said burner head; and fan blades located around the burner head and coupled with said rotor shaft for rotation to withdraw air from the space to be heated via said at least one aperture in the baffle and to return that air between the periphery of the baffle and said transversely extending walls to the space to be heated.

2. An assembly as claimed in claim 1 in which the fan blades are secured to the rotor shaft for rotation therewith.

3. An assembly as claimed in claim 2 in which the burner head is secured to the rotor shaft by a nut engaged with a threaded portion of the rotor shaft.

4. An assembly as claimed in claim 1, wherein said at least one aperture surrounds said central area of the baffle.

5. An assembly as claimed in claim 4, wherein said air inlet comprises a plurality of apertures in said baffle.

6. A gaseous fuel burner for heating a space defined in part by walls extending transversely from a back wall; comprising a baffle positioned within said space to provide airflow space between the baffle and said back wall and between the periphery of the baffle and said transversely extending walls; said baffle having at least one aperture therein; a gaseous fuel burner including a burner head supported between the baffle and said back wall, said burner located centrally of the baffle; a fuel supply conduit communicating with said burner head; a motor having a rotor shaft, said burner head mounted on the rotor shaft for rotation therewith, said rotor shaft passing through the fuel supply conduit; fan blades located around and fixed to said burner head to rotate therewith for withdrawing air from the space to be heated via said at least one aperture in the baffle to said airflow space between the baffle and said back wall and returning that air through said airflow space at the periphery of the baffle to the space to be heated.

7. An assembly as claimed in claim 6 in which the burner head has a tubular extension that is idrivably coupled to the rotor shaft.

8. An assembly as claimed in claim 6, wherein said air inlet surrounds an area of said baffle confronted by said burner head.

9. A gaseous fuel burner assembly for heating a space defined in part by walls extending transversely from an end wall; a baffle positioned within said space to permit air flow path at its periphery between said baffle and said transversely extending walls; said baffle having at least one aperture therein; a gaseous fuel burner having a burner head located in a region between the baffle and said end wall, said burner head positioned centrally of the baffle and, also positioned in said region between the baffle and said end wall, fan blades located around the burner head, said fan blades coupled to a motor for rotation to withdraw air from the space to be heated via the at least one aperture in the baffle into said region between the baffle and said end wall and returning that air between the periphery of the baffle and said transversely extending walls to the space to be heated.

10. An assembly as claimed in claim 9 and further comprising a gaseous fuel supply conduit communicating with the fuel burner and an injector positioned to direct gaseous fuel into the conduit.

11. An assembly as claimed in claim 9, in which the burner head comprises a hollow cylindrical body whose interior is in communication with a gaseous fuel supply conduit, said cylindrical body including an end surface defined by a porous disc that forms a combustion surface of the burner head.

12. An assembly as claimed in claim 9 wherein said burner head arranged is arranged coaxially with a further burner head, a first fuel supply conduit joined to one of the burner heads, and a second fuel supply conduit located within the first conduit and joined to the other burner head.

13. An assembly as claimed in claim 9 comprising a further burner head, a fuel supply conduit for each burner head, each conduit having a bell-like end, and a combustion surface mounted at the bell-like end of each conduit.

14. An assembly as claimed in claim 9 comprising a further burner head, an inner fuel supply conduit communicating with one of said burner heads, an outer fuel supply conduit communicating with the other of said burner heads, said conduits located one within the other; a motor, having a drive output rotor shaft secured to said inner conduit, the outer conduit secured to the inner conduit and the fan secured to the inner conduit.

15. An assembly as claimed in claim 9 in which the baffle has a floor and said air inlet comprises an annular aperture in said floor.

16. An assembly as claimed in claim 9 in which the baffle has an aperture positioned in front of the burner and a window of a heat resistant material positioned in the aperture.

17. An assembly as claimed in claim 9 wherein said air inlet comprises a plurality of apertures.

18. An assembly as claimed in 17 in which the baffle has a floor, and said plurality of apertures is arranged in several concentric circles in said floor.

19. An assembly as claimed in claim 9 wherein said air inlet is located outwardly of and surrounds said burner head.

20. A method of heating a space defined in part by walls extending transversely from an end wall, said space having a baffle located therein spaced from said end wall; comprising the steps of heating the baffle by a heating source located centrally of the baffle in a region between the baffle and said end wall; inducing a forced airflow from said space to be heated into said region between said baffle and said end wall through a region of the heated baffle located outwardly of said heating source, said airflow returning around peripheral edges of said baffle to said space to be heated.

21. A method claimed in claim 20, wherein said forced airflow is induced through regions of the baffle surrounding the heating source.

22. A method as claimed in claim 20 wherein said forced airflow is induced by rotating fan blades surrounding the heating source.

23. A method as claimed in claim 22 wherein said heating source is rotated together with said fan blades.

24. A cooking appliance having walls extending transversely from a back wall to bound part of a cavity providing a cooking space; a gaseous fuel burner supporting a burner head located in said cavity; fan blades positioned around said burner head; a baffle positioned within said cavity and spaced from said back wall to separate said burner head and said fan blades from said cooking space; said baffle providing air flow space at its periphery between said baffle and said transversely extending walls; said baffle having at least one aperture extending through the baffle; said burner head located centrally of and facing the baffle; and wherein said fan blades are coupled to a motor for rotation to withdraw air from the cooking space via said at least one aperture in the baffle, and to return said withdrawn air back to said cooking space.

25. A cooking appliance as claimed in claim 24 wherein said at least one aperture is located in surrounding relation with said burner head.

26. A cooking appliance as claimed in claim 24 wherein said motor has a rotor shaft drivably coupled to said fan blades and to said burner head, and wherein said rotor shaft is a gaseous fuel supply conduit communicating with said burner head.

27. A cooking appliance as claimed in claim 24 wherein said motor has a rotor shaft drivably coupled to said fan blades, and wherein said rotor shaft extends through a gaseous fuel supply conduit communicating with said burner head.

* * * * *

UNITED STATES PATENT AND TRADEMARK OFFICE

CERTIFICATE OF CORRECTION

PATENT NO. : 5,568,803

DATED : October 29, 1996

INVENTOR(S) : G.J.E. BROWN

It is certified that error appears in the above-indentified patent and that said Letters Patent is hereby corrected as shown below:

Title page, left column, between lines 7 and 8, insert

--[73] Assignee: Stoves, Ltd., Prescot, England--

Signed and Sealed this

Eighteenth Day of March, 1997

*Attest:*

*Attesting Officer*

BRUCE LEHMAN

*Commissioner of Patents and Trademarks*